US008929513B2

(12) United States Patent
Vadivel et al.

(10) Patent No.: US 8,929,513 B2
(45) **Date of Patent: *Jan. 6, 2015**

(54) COMPACT RADIATION GENERATOR

(75) Inventors: Venugopal Vadivel, Bangalore (IN); Niranjan Kumar, Bangalore (IN)

(73) Assignee: General Electric Company, Schenectady, NY (US)

( * ) Notice: Subject to any disclaimer, the term of this patent is extended or adjusted under 35 U.S.C. 154(b) by 79 days.

This patent is subject to a terminal disclaimer.

(21) Appl. No.: 13/440,605

(22) Filed: Apr. 5, 2012

(65) Prior Publication Data

US 2013/0156160 A1 Jun. 20, 2013

(30) Foreign Application Priority Data

Apr. 15, 2011 (IN) ..... 1298/CHE/2011

(51) Int. Cl.
*H05G 1/12* (2006.01)
*H05G 1/10* (2006.01)
*H05G 1/06* (2006.01)

(52) U.S. Cl.
CPC ... *H05G 1/10* (2013.01); *H05G 1/06* (2013.01)
USPC ..... 378/104; 378/101

(58) Field of Classification Search
CPC ..... H05G 1/10; H05G 1/32; H05G 1/06; H01J 35/025
USPC ..... 378/101, 104
See application file for complete search history.

(56) References Cited

U.S. PATENT DOCUMENTS

| | | | | |
|---|---|---|---|---|
| 3,217,210 | A | 11/1965 | Diebold | |
| 4,720,844 | A | 1/1988 | Bougle | |
| 5,923,723 | A | 7/1999 | Herbst | |
| 7,620,151 | B2 * | 11/2009 | Sundaram et al. | 378/104 |

* cited by examiner

*Primary Examiner* — Jurie Yun
(74) *Attorney, Agent, or Firm* — Global Patent Operation; Mark A. Conklin

(57) ABSTRACT

A voltage rectifier circuit for a radiation generator is provided. The voltage rectifier circuit comprises at least one ring shaped first printed circuit board and at least one ring shaped second printed circuit board coupled to each other using a plurality of connectors and wherein each of the first and second printed circuit boards comprise, a first terminal, a second terminal, and a third terminal. The first terminal and second terminal are connected via an external diode assemble, and the first and third terminal are connected by a capacitor assembly embedded between them.

10 Claims, 9 Drawing Sheets

100

COMPACT RADIATION GENERATOR

BACKGROUND OF THE INVENTION

1. Field of the Invention

The subject matter described herein generally relates to a radiation generator and more particularly to a high voltage tank assembly used in a radiation generator.

2. Description of Related Art

An imaging device comprising a 'C' arm incorporates a radiation generator and a radiation detector. The radiation generator generally comprises a radiation source, a high voltage tank assembly configured to energize the radiation source and a power circuit. As the high voltage tank assembly responsible for generating the high voltage required for the operation of the radiation source represents a substantial part of the overall size of the radiation generator, it is desirable to provide a compact high voltage tank assembly.

Further, the high voltage tank assembly comprises a voltage rectifier circuit and a transformer assembly coupled to the voltage rectifier circuit. The voltage rectifier circuit and the transformer assembly are amongst bulky modules of the radiation generator.

The high voltage required by the radiation source is delivered by the high-voltage tank assembly typically using a connecting means. However, the connecting means between the high-voltage tank assembly located outside a shield housing and the radiation source located within the shield housing is cumbersome as well as expensive. Further, this arrangement may lead to radiation leakage. The connecting means generally comprises conductors housed inside a cable. Employing the conductors housed within the cable makes the radiation generator bulky which is incompatible with the mobility which is desired by for a diagnostic radiology installation.

On the other hand, when the high voltage tank assembly and the radiation source are together housed within the shield housing and the high voltage required by the radiation source is delivered directly by the high-voltage tank assembly, the radiation generator is nevertheless subject to disadvantages since the weight and bulk of this unit are greater than those of the assembly consisting of the housing, which contains the radiation source alone.

In view of the foregoing, there exists a need to provide a compact and efficient design for assembling various components used in the radiation generator.

BRIEF DESCRIPTION OF THE INVENTION

According to an embodiment of the invention, a radiation generator is provided. The radiation generator comprises an X-ray tube comprising a cathode and an anode, the X-ray tube enclosed in a shield housing. The radiation generator also comprises a high voltage tank assembly configured to power the X-ray tube. The high voltage tank assembly comprises a transformer assembly configured to supply an intermediate voltage, and at least one voltage rectifier circuit coupled to the transformer assembly, the at least one voltage rectifier circuit being mounted within the shield housing and configured to deliver high voltage to the X-ray tube. Further, the at least one voltage rectifier circuit comprises a series of rings positioned around the X-ray tube so as to provide a progressive increase in voltage. Accordingly, the at least one voltage rectifier circuit comprises at least one ring shaped first printed circuit board and at least one ring shaped second printed circuit board coupled to each other using a plurality of connectors. Each of the first and second printed circuit boards comprise a first terminal, a second terminal, a third terminal, a diode assembly externally connected between the first terminal and the second terminal and a capacitor assembly connected between the first terminal and the third terminal.

In another embodiment of the invention, a voltage rectifier circuit for a radiation generator is provided. The voltage rectifier circuit comprises at least one ring shaped first printed circuit board and at least one ring shaped second printed circuit board coupled to each other using a plurality of connectors. Each of the first and second printed circuit boards comprise a first terminal, a second terminal, and a third terminal, a diode assembly externally connected between the first terminal and the second terminal and a capacitor assembly embedded between the second terminal and the third terminal.

In yet another embodiment of the invention, a radiation generator is provided. The radiation generator comprises an X-ray tube comprising a cathode and an anode, the X-ray tube enclosed in a shield housing. The radiation generator also comprises a high voltage tank assembly configured to power the X-ray tube. The high voltage tank assembly comprises a transformer assembly configured to supply an intermediate voltage, and at least one voltage rectifier circuit coupled to the transformer assembly, the at least one voltage rectifier circuit being mounted within the shield housing and configured to deliver high voltage to the X-ray tube. Further, the at least one voltage rectifier circuit comprises a series of rings positioned around the X-ray tube so as to provide a progressive increase in voltage. Accordingly, the at least one voltage rectifier circuit comprises at least one ring shaped printed circuit board having a first layer and a second layer. Each of the first and second layer comprise a first terminal, a second terminal, a third terminal, a diode assembly externally connected between the first terminal and the second terminal and a capacitor assembly connected between the first terminal and the third terminal.

Systems and methods of varying scope are described herein. In addition to the aspects and advantages described in this summary, further aspects and advantages will become apparent by reference to the drawings and with reference to the detailed description that follows.

BRIEF DESCRIPTION OF THE DRAWINGS

There follows a detailed description of embodiments of the present invention by way of example only and made with reference to the accompanying schematic drawings, in which.

DETAILED DESCRIPTION OF THE INVENTION

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

An imaging apparatus such as a computed tomography apparatus and an X ray apparatus, configured to image objects, comprises a radiation generator, a radiation detector and a data acquisition system. The radiation generator generates electromagnetic radiation for projection towards the object to be scanned. The electromagnetic radiation includes X rays, gamma rays and other HF electromagnetic energy. The X rays incident on the object being scanned are attenuated by the object. The radiation detector comprises multiple detector elements for converting the attenuated X rays into electrical signals. The electrical signals so formed are named as projection data. The data acquisition system (DAS) samples the projection data from the detector elements and converts the projection data into digital signals for computer processing.

Embodiments of the invention relate to design layout and packaging for a high power radiation generator typically used in applications such as, but not limited to, portable/mobile X-ray radiographic system, medium power C-arm, bone densitometry system and nuclear medicine system.

Figure 1:
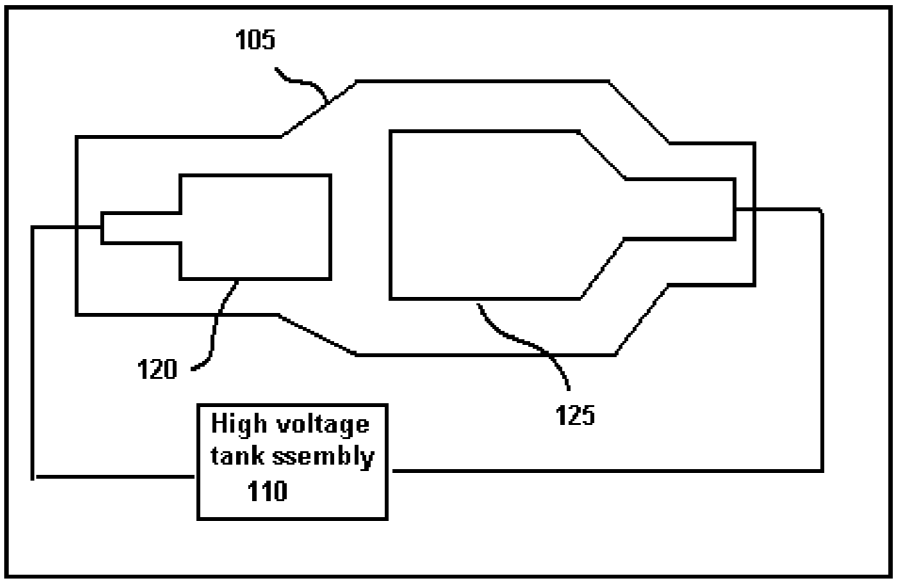
FIG. 1 shows a schematic diagram of an exemplary embodiment of a radiation generator.

FIG. 1 shows an exemplary embodiment of a radiation generator 100. In the illustrated embodiment of FIG. 1, the radiation generator 100 is an X-ray generator and the radiation source is an X-ray tube 105 electrically coupled in a conventional manner to a high voltage tank assembly 110 so as to create an emission of X-rays. The X-ray tube 105 is of conventional design and is represented by an envelope comprising a cathode 120 and an anode 125. The radiation generator 100 further comprises a power circuit (not shown) coupled to the high voltage tank assembly 110, configured to supply power to drive the high voltage tank assembly 110.

Figure 2:
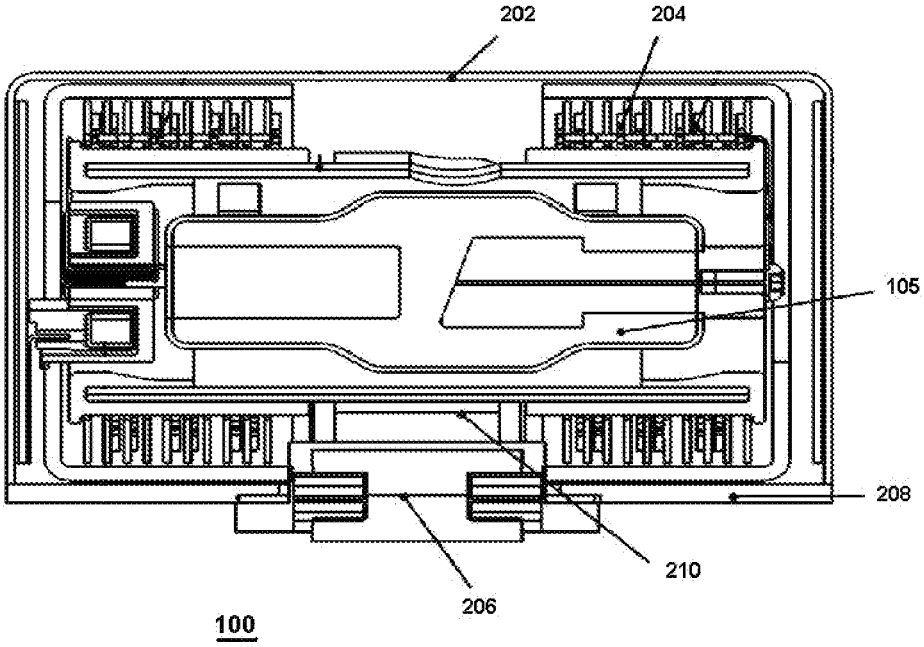
FIG. 2 shows detailed view of the radiation generator shown at FIG. 1.

FIG. 2 shows a detailed front view of the radiation generator 100 shown in FIG. 1. The elements, which are the same as, or correspond to, elements of FIG. 1, are denoted by the same reference numerals, so that in this sense the description need not be repeated and only the differences will be dealt with.

Figure 3:
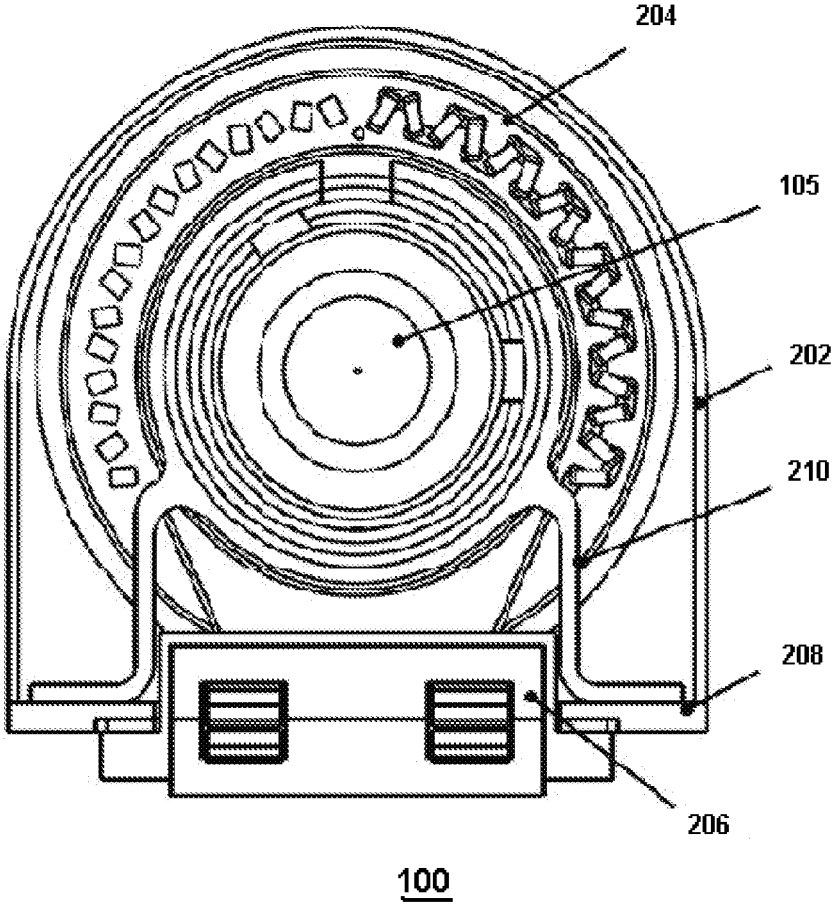
FIG. 3 shows a schematic diagram of a cross sectional view of the radiation generator shown at FIG. 1.

As shown in FIG. 2, the high voltage tank assembly 110 capable of powering the X-ray tube 105 comprises a transformer assembly 206 configured for supplying an intermediate voltage and at least one voltage rectifier circuit 204 coupled to the transformer assembly 206. In one embodiment, the power circuit (not shown), the transformer assembly 206 and the voltage rectifier circuit 204 are housed along with the X-ray tube 105 within a shield housing 202. This is explained in conjunction with FIG. 3 showing a detailed side view of the radiation generator 100 shown at FIG. 1. As shown in FIG. 2 and FIG. 3, the shield housing 202 is connected to a base plate 208 via a support device 210 and is covered with an external casing. Note that, though not shown, the shield housing 202 for radiation generator 100 is filled with a cooling medium, such as insulation oil.

The voltage supplied from an external power supply is passed through the power circuit (not shown) and is supplied to the transformer assembly 206 in order to generate an intermediate voltage. The intermediate voltage is converted into a high voltage by means of the voltage rectifier circuit 204. The high voltage is applied between the cathode 120 and anode 125 of X-ray tube 105. Thus, the X-ray tube 105 is driven by the high voltage and emits an X-ray beam onto the object, thereby to obtain projection data from the X-rays passing through the object.

The voltage rectifier circuit 204 for generating anode voltage at the X-ray tube 105, commonly referred to as anode multiplier, and the voltage rectifier circuit 204 for generating the cathode voltage at the X-ray tube 105, commonly referred to as cathode multiplier, are separate components, which operate independently of each other. This is further explained in conjunction with FIG. 4.

The voltage rectifier circuit 204 comprises a plurality of serially connected voltage multiplying-rectifying stages having a low voltage potential end and a high voltage potential end. The low voltage potential end is connected to the secondary winding of the transformer assembly 206 and the high voltage potential end is connected to the electrodes 120 and 125 of the X-ray tube 105.

Figure 4:
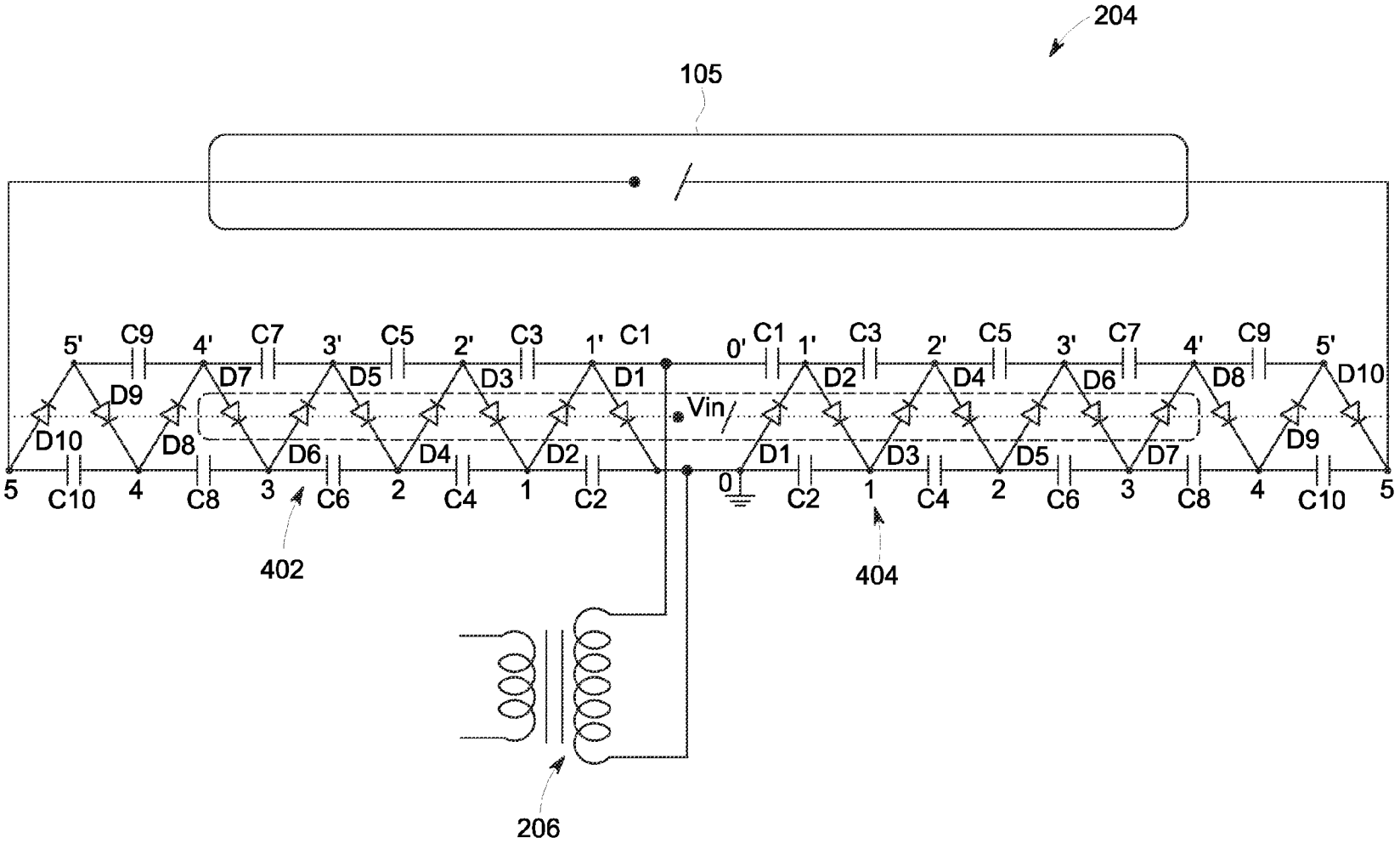
FIG. 4 shows a schematic diagram of exemplary circuit layout of the radiation generator shown at FIG. 1.

FIG. 4 shows one exemplary circuit layout of the radiation generator 100 comprising a five-stage voltage rectifier circuit 204. The voltage rectifier circuit 204 comprises a cathode multiplier 402 and an anode multiplier 404 placed around the X-ray tube 105 at both ends. The voltage rectifier circuit 204 is coupled to the transformer assembly 206 as shown in FIG. 4.

In one embodiment, the invention more particularly describes the placement of one or more components of the voltage rectifier circuit 204 comprising a series of ring shaped printed circuit boards positioned around a radiation source so as to provide a progressive increase in voltage. Accordingly, the voltage rectifier circuit 204 comprises at least one ring shaped first printed circuit board and at least one ring shaped second printed circuit board coupled to each other using plurality of connectors. The ring shaped voltage rectifier circuit 204 positioned around the radiation source (X-ray tube 105) makes the radiation generator 100 compact and lightweight.

The components in the high voltage tank assembly 110 are arranged based on Cockcroft Walton multiplier circuit pattern. Accordingly, the diodes and capacitors of the voltage rectifier circuit 204 are electrically coupled to one or more of the series of the ring shaped printed circuit boards, positioned around the X-ray tube 105, so as to give rise to a uniform and symmetrical field distribution along the length of the X-ray tube 105. The field stress between the electrical components is thereby reduced.

Figure 5:
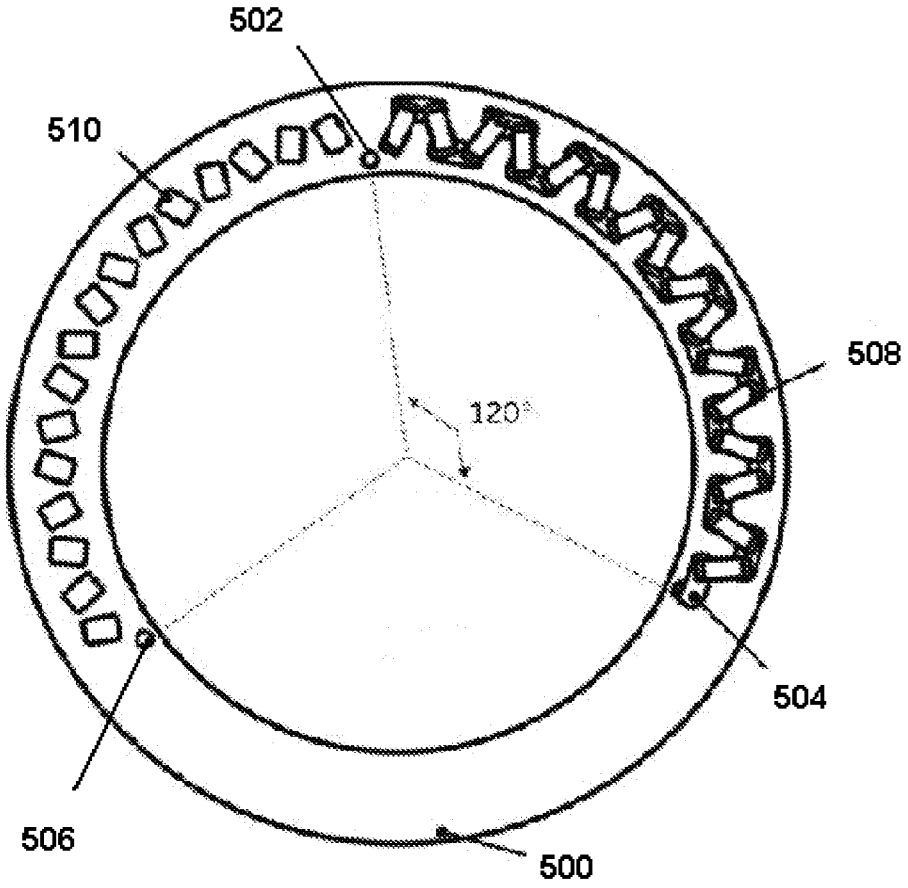
FIG. 5 shows a schematic diagram of a basic block of a voltage rectifier circuit.

FIG. 5 shows a basic block of the voltage rectifier circuit 204 comprising at least one ring shaped printed circuit board 500. In one embodiment, each ring shaped printed circuit board 500 is divided into three sectors by three terminals: a first terminal 502, second terminal 504 and third terminal 506 located equidistant from one another. A diode assembly 508 is mounted between the first terminal 502 and the second terminal 504 and the capacitor assembly 510 is mounted between the first terminal 502 and the third terminal 506. The diode assembly 508 comprises a plurality of diodes connected in series and the capacitor assembly 510 comprises at least a portion of the printed circuit board 500.

Further, each ring shaped printed circuit board 500 may comprise a plurality of dielectric mediums and each dielectric medium may be separated by at least one electrically conductive plane. The conductive planes in the printed circuit board 500 may be used as electrodes, and dielectric medium in the printed circuit board 500 may be used as insulation to form capacitance. Further, each capacitor assembly 508 may comprise at least a portion of the corresponding printed circuit board 500 formed by addition of capacitance in multiple layers of the printed circuit board 500. Thus, the capacitance so formed helps in effectively packing various components of the high voltage tank assembly 110.

In an alternative embodiment, the capacitor assembly 510 can be a combination of commercially available capacitors and a portion of the printed circuit board 500. The printed circuit board 500 when used in combination with the commercially available capacitors provides an optimized solution to cost and space.

In one embodiment, in order to utilize a single layer and to overcome the constraint in dimension for packaging the components of the voltage rectifier circuit 204, the diodes can be selected to be surface mount devices (SMD). The main advantage of using SMDs is the availability of adequate space in each printed circuit board 500 to be formed as a capacitor.

Each of the diode assembly 508 and the capacitor assembly 510 are placed on the printed circuit board 500 such that they each occupy a single sector. In FIG. 5 the points 502, 504 and 506 indicate multiple pins that are spaced at an angle of 120 degree. The pins are employed to couple the printed circuit board 500 to a succeeding printed circuit board. Further, each of the printed circuit boards in the voltage rectifier circuit 204 is symmetrical in construction. The symmetrical design helps in stacking multiple printed circuit boards. This is further explained in conjunction with FIG. 6 and FIG. 7.

Figure 6:
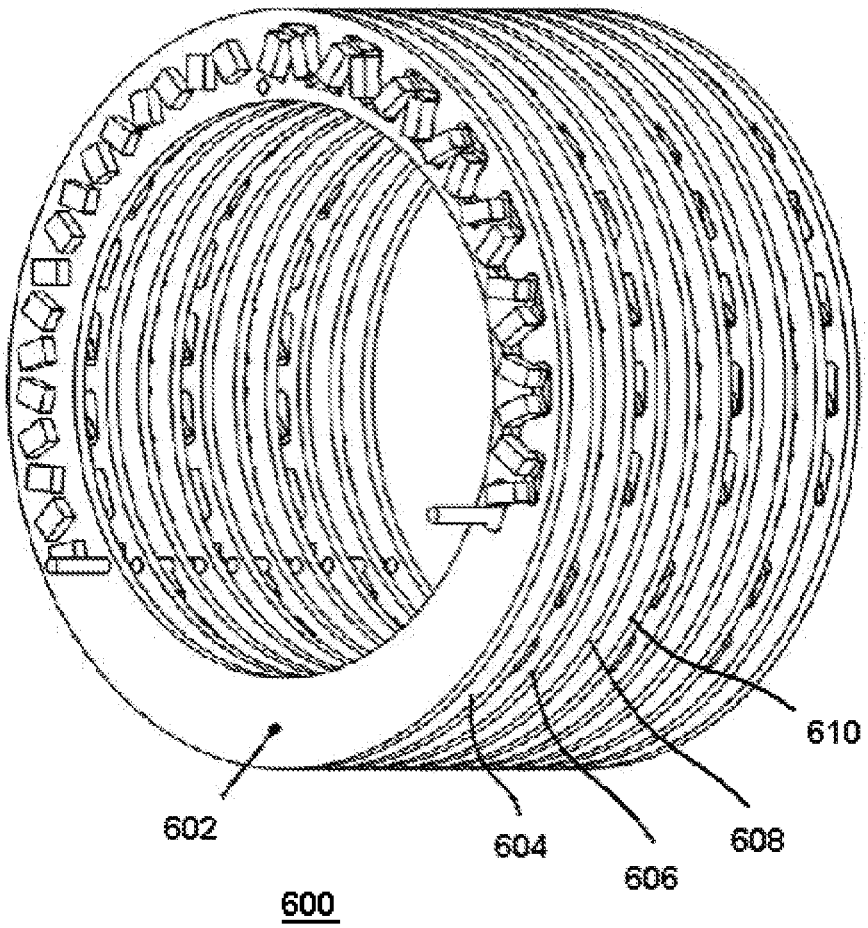
FIG. 6 shows a schematic diagram of an exemplary embodiment of a voltage rectifier circuit.

The voltage rectifier circuit 204 can be configured to function as a voltage multiplier circuit or a voltage doubler circuit. Each stage of the voltage rectifier circuit 204 comprises two diode assemblies and two capacitor assemblies, for example, C1, D1 and C2, D2 for the first stage. In one embodiment, the voltage rectifier circuit 204 is configured to include at least two ring shaped single layered printed circuit boards. Accordingly, in one exemplary embodiment, FIG. 6 shows a five-stage voltage rectifier circuit 600 comprising ten single layer ring shaped printed circuit boards including printed circuit boards 602, 604, 606, 608 and 610. In the voltage rectifier circuit 600 comprising a series of ring shaped single layer printed circuit boards, each stage of the voltage rectifier circuit 600 comprises a first single layer printed circuit board and a second single layer printed circuit board. Each of the first and second single layer printed circuit boards comprise one diode assembly and one capacitor assembly.

Each succeeding ring shaped printed circuit board in the voltage rectifier circuit 600 is coupled to the preceding ring shaped circuit board by performing angular rotation of the succeeding ring shaped printed circuit board by a predetermined angle of approximately 120 degrees. Accordingly, in the first stage of the voltage rectifier circuit 600, the second ring shaped printed circuit board 604 is coupled to the first ring shaped printed circuit board 602 by rotating the second ring shaped printed circuit board 604 by approximately 120 degrees.

Similarly, the third ring shaped printed circuit board 606 is rotated by approximately 120 degrees prior to being coupled to the second ring shaped printed circuit board 604. Further, the fourth ring shaped printed circuit board 608 is rotated by approximately 120 degrees prior to being coupled to the third ring shaped printed circuit board 606 to form the second stage.

In this embodiment, the first terminal of the first printed circuit board 602 is connected to the second terminal of a second printed circuit board 604, the third terminal of the first printed circuit board 602 is connected to the first terminal of the second printed circuit board 604 and the second terminal of the first printed circuit board 602 is connected to the third terminal of the second printed circuit board 604. Furthermore, the third terminal of the second printed circuit board 604 is connected to a point maintained at a ground potential and the third terminal of the first printed circuit board 602 is connected to the X-ray tube 105.

Skilled artisans shall, however, appreciate that the connections between various terminals in each stage of the voltage rectifier circuit 600 can vary to enhance the rating or reliability of the corresponding stage, thus resulting in an enhanced performance of each stage.

Figure 7:
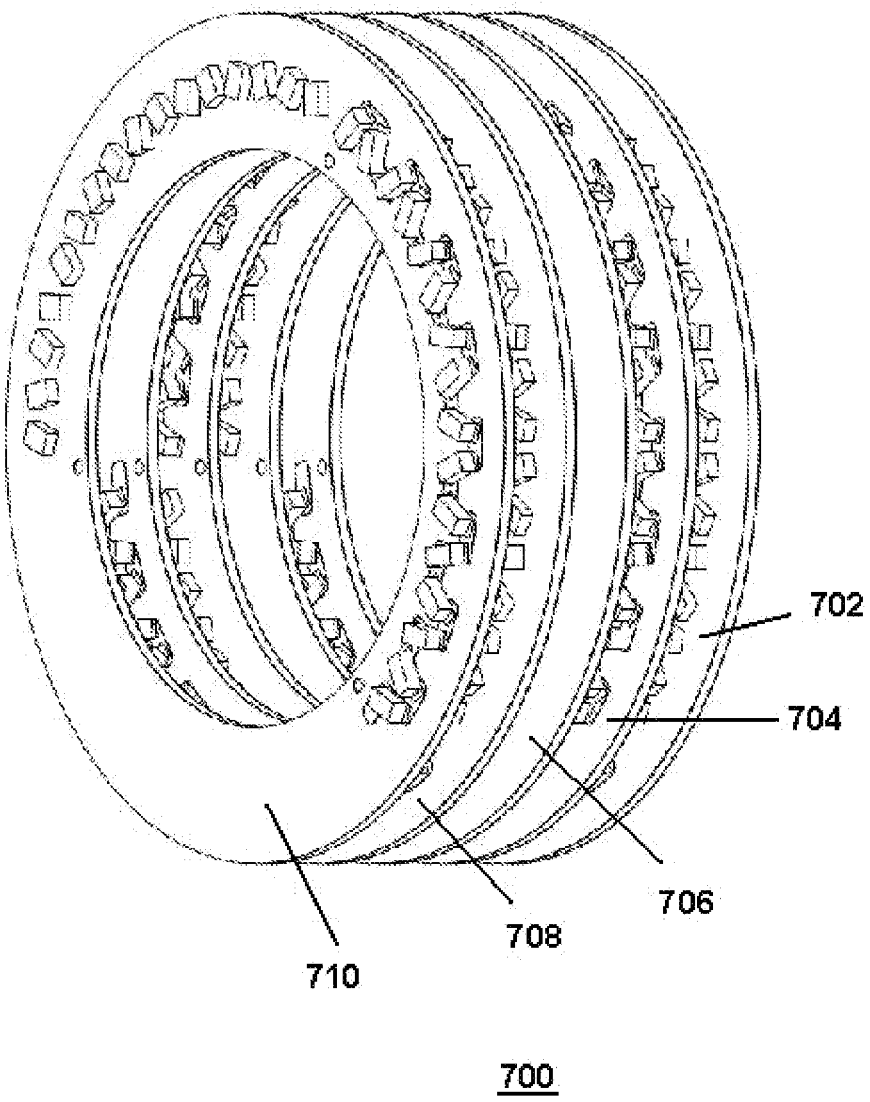
FIG. 7 shows a schematic diagram of another exemplary embodiment of a voltage rectifier circuit.

In another embodiment, as shown in FIG. 7, the voltage rectifier circuit 700 comprises a series of double-layered printed circuit boards 702, 704, 706, 708 and 710 each representing a single stage in the voltage rectifier circuit 700. In this embodiment, each succeeding ring shaped printed circuit board (for example 604) is coupled to the preceding ring shaped print circuit board (for example 602) after performing an angular rotation of the succeeding ring shaped printed circuit board (604) by about 240 degrees.

In another embodiment, an insulation technique is utilized to facilitate the reduction in size of the radiation generator 100. The high voltage tank assembly 110 employs a hybrid insulation scheme comprising a solid insulation that doubles up to perform radiation shielding. The solid insulation generally comprises lead and other such material. Inserting solid insulating sheets between successive printed circuit boards strengthens the insulation between the series of ring shaped printed circuit boards. Further, positioning the insulation material surrounding the X-ray tube 105 decreases the amount of material required for insulation and hence reduces the overall weight of the high voltage tank assembly 110.

Figure 8:
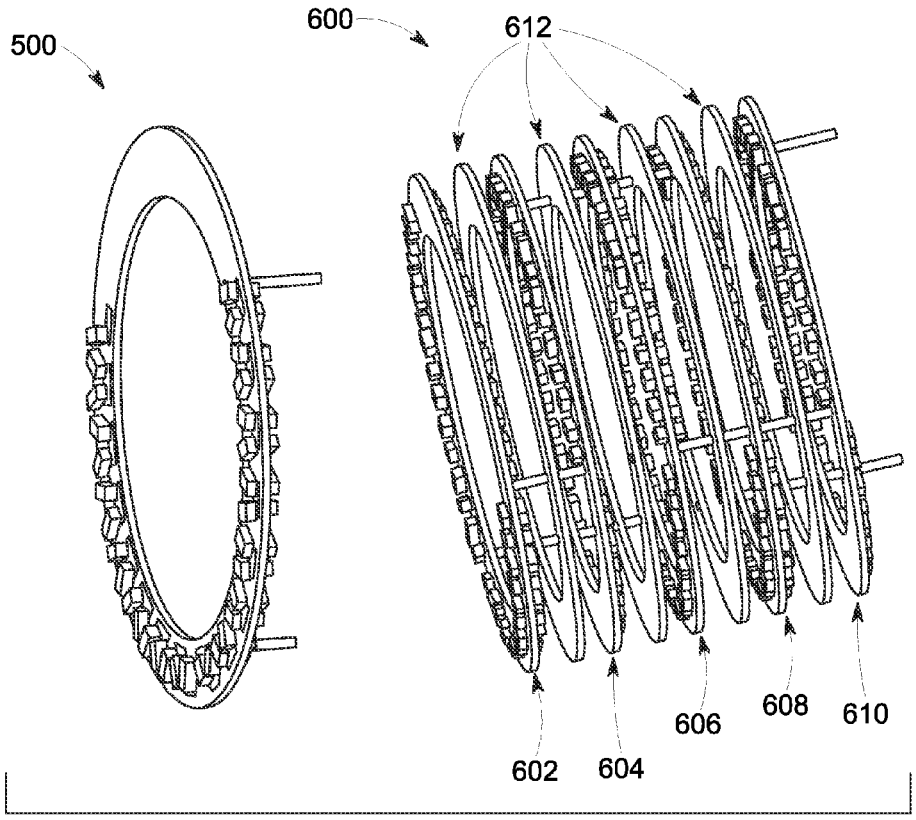
FIG. 8 shows a schematic diagram of exemplary embodiment of a double sided ring printed circuit board.

In another embodiment, FIG. 8 shows a five-stage voltage rectifier circuit 600 comprising ten single layer ring shaped printed circuit boards including printed circuit boards 602, 604, 606, 608 and 610. The printed circuit boards are double sided and ring form. First insulation sheets 612 are inserted between any two successive printed circuit boards 602, 604, 606, 608 and 610. First insulation sheet 612 is used for providing additional insulation between two stacked double sided ring printed circuit boards in ring shape and covers the complete shape. In a particular embodiment, the additional insulation 612 may be achieved by solid or liquid insulating material.

Figure 9:
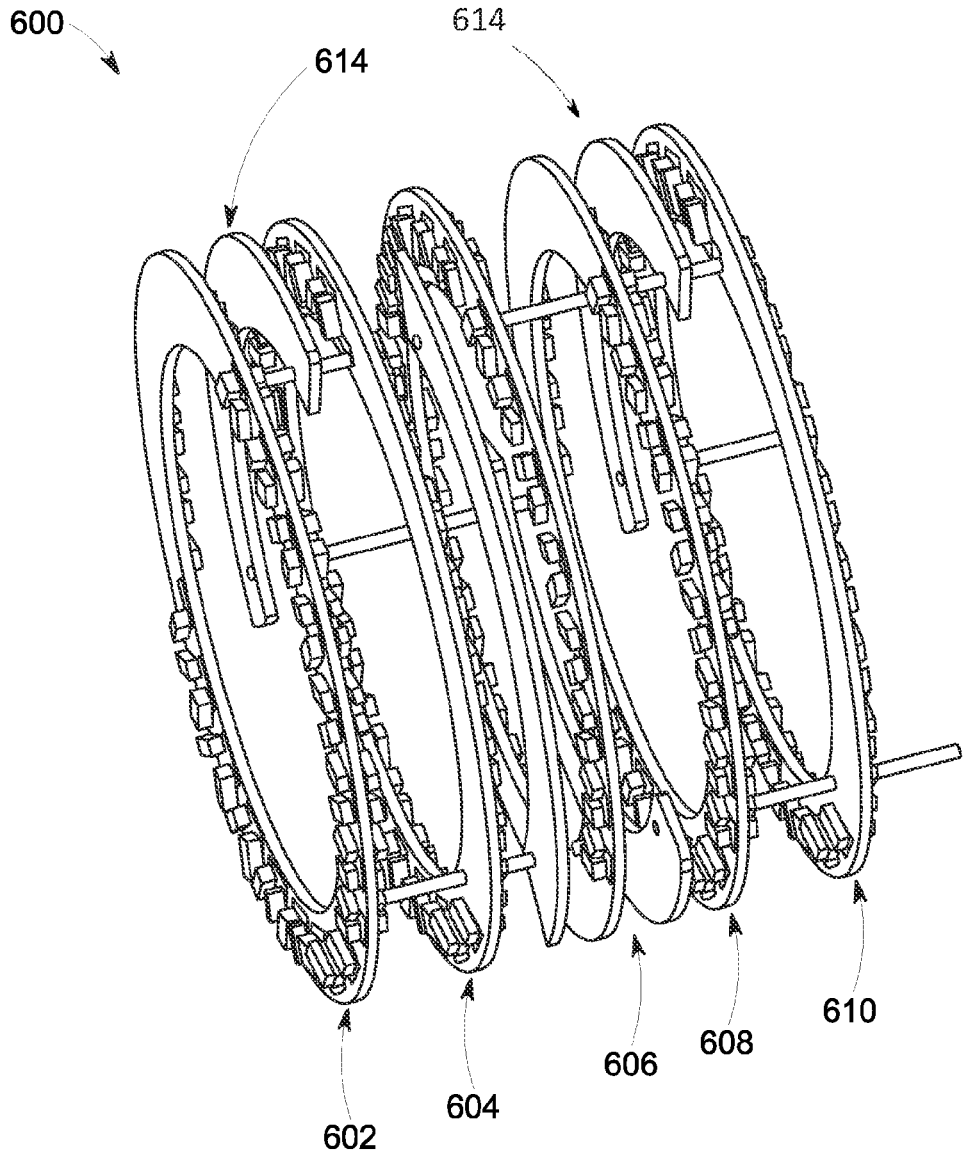
FIG. 9 shows a schematic diagram of another exemplary embodiment of a double sided ring printed circuit board.

In another exemplary embodiment, FIG. 9 further describes a five-stage voltage rectifier circuit 600 of FIG.8 including printed circuit boards 602, 604, 606, 608 and 610. The printed circuit boards are double sided and ring form. Second insulation sheets 614 are inserted between any two successive printed circuit boards 602, 604, 606, 608 and 610. Second insulation sheets 614 are used for providing additional insulation between two stacked double sided ring printed circuit boards 602, 604, 606, 608 and 610 covering $1/3^{rd}$ of ring circumference of the printed circuit boards 602, 604, 606, 608 and 610 , where the second insulation sheets 614 are facing each other after stacking.

This assembly of the voltage rectifier circuit 204 along with the solid insulating sheets is immersed in a liquid insulation to provide additional insulation between two successive high voltage points and to also improve the thermal performance. The liquid insulation typically comprises oil, but other insulation liquids are envisioned to be included in embodiments of the invention. The area present between adjacently positioned printed circuit boards provides sufficient space for oil circulation, which helps in dispersing heat from high voltage tank assembly 110 through electro convection phenomena.

In yet another embodiment, a radiation shielding technique is utilized to reduce radiation leakage in the X-ray tube 105. The arrangement also improves thermal performance of the radiation generator 100. As the voltage rectifier circuit 204 is located within the shield housing 202 along with the X-ray tube 105, the anode wire of the voltage rectifier circuit 204 is connected to the X-ray tube 105 directly without causing any radiation leakage. This also improves the thermal performance of the high voltage tank assembly 110 as the shield housing 202 is devoid of openings for facilitating external connections and moreover as the radiation shielding technique does not block liquid circulation.

Few of the advantages of the radiation generator 100 described in various embodiments of the invention are described herein. Placement of the voltage rectifier circuit 204 in ring shape around the X-ray tube 105, results in gradual voltage distribution along the length of the X-ray tube 105 and due to its cylindrical shape it reduces the overall volume and hence the weight of the radiation generator 100.

The integrated radiation generator described in various embodiments herein is compact in size, light in weight and has a reduced radiation leakage with enhanced patient throughput. This is desired in mobile/portable radiographic system application. Lightweight facilitates transportation; reduced radiation leakage discounts the requirement of special screening rooms for imaging patients thereby facilitating carrying out radiation exposure in an informal environment with reduced precautions. Increased patient throughput indicates better thermal performance enabling the usage of the imaging apparatus for longer duration of time.

In various embodiments of the invention, a high voltage tank assembly for a radiation generator and a radiation generator using a high voltage tank assembly are described. However, the embodiments are not limited and may be implemented in connection with different applications. The application of the invention can be extended to other areas, for example medical imaging systems, industrial inspection systems, security scanners, particle accelerators, etc. The invention provides a broad concept of designing a voltage rectifier circuit, which can be adapted in a similar power supply system. The design can be carried further and implemented in various forms and specifications.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radiation generator comprising:

an X-ray tube comprising a cathode and an anode, the X-ray tube enclosed in a shield housing; and a high voltage tank assembly configured to power the X-ray tube, the high voltage tank assembly comprising:

a transformer assembly configured to supply an intermediate voltage;

at least one voltage rectifier circuit coupled to the transformer assembly, the at least one voltage rectifier circuit being mounted within the shield housing (202) and configured to deliver high voltage to the X-ray tube, wherein the at least one voltage rectifier circuit comprises a series of rings positioned around the X-ray tube so as to provide a progressive increase in voltage, the at least one voltage rectifier circuit comprising at least one ring shaped first printed circuit board and at least one ring shaped second printed circuit board coupled to each other using a plurality of connectors, and wherein each of the first and second printed circuit boards comprise a first terminal, a second terminal, a third terminal, a diode assembly externally connected between the first terminal and the second terminal and a capacitor assembly embedded between the first terminal and the third terminal.

2. The radiation generator of claim 1, wherein each printed circuit board further comprises a plurality of dielectric mediums, each dielectric medium being separated by at least one electrically conductive plane.

3. The radiation generator of claim 2, wherein the diode assembly comprises a plurality of diodes connected in series and the capacitor assembly comprises at least a portion of the printed circuit board.

4. The radiation generator of claim 1, wherein the first terminal of the first printed circuit board is connected to the second terminal of the second printed circuit board, the third terminal of the first printed circuit board is connected to the first terminal of the second printed circuit board and the second terminal of the first printed circuit board is connected to the third terminal of the second printed circuit board.

5. The radiation generator of claim 4, wherein the third terminal of the second printed circuit board is connected to a point maintained at a ground potential and the third terminal of the first printed circuit board is connected to the X-ray tube.

6. The radiation generator of claim 1, wherein the high voltage tank assembly further comprises a first insulating medium inserted between the first printed circuit board and the second printed circuit board.

7. The radiation generator of claim 6, wherein the high voltage tank assembly further comprises a second insulating medium covering at least a portion in between the first printed circuit board and the second printed circuit board.

8. The radiation generator of claim 1, wherein the voltage rectifier circuit is configured to be used in one of a voltage multiplier circuit and a voltage doubler circuit.

9. A voltage rectifier circuit for a radiation generator, the voltage rectifier circuit comprising:

at least one ring shaped first printed circuit board and at least one ring shaped second printed circuit board coupled to each other using a plurality of connectors and wherein each of the first and second printed circuit boards comprise, a first terminal, a second terminal, a third terminal, a diode assembly externally connected between the first terminal and the second terminal and a capacitor assembly embedded between the first terminal and the third terminal.

10. A radiation generator comprising:

an X-ray tube comprising a cathode and an anode, the X-ray tube enclosed in a shield housing; and a high voltage tank assembly configured to power the X-ray tube, the high voltage tank assembly comprising:

a transformer assembly configured to supply an intermediate voltage;

at least one voltage rectifier circuit coupled to the transformer assembly, the at least one voltage rectifier circuit being mounted within the shield housing and configured to deliver high voltage to the X-ray tube, wherein the at least one voltage rectifier circuit comprises a series of rings positioned around the X-ray tube so as to provide a progressive increase in voltage, the at least one voltage rectifier circuit comprising at least one ring shaped printed circuit board having a first layer and a second layer, and wherein each of the first and second layer comprise a first terminal, a second terminal, a third terminal, a diode assembly externally connected between the first terminal and the second terminal and a capacitor assembly embedded between the first terminal and the third terminal.

* * * * *

UNITED STATES PATENT AND TRADEMARK OFFICE

CERTIFICATE OF CORRECTION

PATENT NO. : 8,929,513 B2
APPLICATION NO. : 13/440605
DATED : January 6, 2015
INVENTOR(S) : Vadivel et al.

It is certified that error appears in the above-identified patent and that said Letters Patent is hereby corrected as shown below:

In the Specification,

In Column 2, Line 56, delete "circuit; and" and insert -- circuit; --, therefor.

In Column 2, Line 58, delete "circuit." and insert -- circuit; --, therefor.

In Column 2, Line 60, delete "board." and insert -- board; and --, therefor.

In Column 4, Line 64, delete "assembly 508" and insert -- assembly 510 --, therefor.

In the Claims,

In Column 7, Line 60, in Claim 1, delete "housing (202)" and insert -- housing --, therefor.

Signed and Sealed this
Fifth Day of May, 2015

Michelle K. Lee

Michelle K. Lee
*Director of the United States Patent and Trademark Office*